US009038350B2

(12) United States Patent
Hohmann, Jr.

(10) Patent No.: US 9,038,350 B2
(45) Date of Patent: May 26, 2015

(54) ONE-PIECE DOVETAIL VENEER TIE AND WALL ANCHORING SYSTEM WITH IN-CAVITY THERMAL BREAKS

(71) Applicant: MITEK HOLDINGS, INC., Wilmington, DE (US)

(72) Inventor: Ronald P. Hohmann, Jr., Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 14/046,556

(22) Filed: Oct. 4, 2013

(65) Prior Publication Data

US 2015/0096243 A1 Apr. 9, 2015

(51) Int. Cl.

| | |
|---|---|
| ***E04B 1/38*** | (2006.01) |
| ***E04C 5/00*** | (2006.01) |
| ***E04B 1/76*** | (2006.01) |
| ***E04B 1/41*** | (2006.01) |
| ***E04B 1/98*** | (2006.01) |
| ***E04B 2/30*** | (2006.01) |

(52) U.S. Cl.

CPC ..... *E04B 1/7616* (2013.01); *E04B 1/4178* (2013.01); *E04B 1/98* (2013.01); *E04B 2/30* (2013.01)

(58) Field of Classification Search

USPC ..... 52/562–565, 167.1, 506.01, 379, 383, 52/710, 713, 649.1, 698, 699

See application file for complete search history.

(56) References Cited

U.S. PATENT DOCUMENTS

| | | | | |
|---|---|---|---|---|
| 819,869 | A | 5/1906 | Dunlap | |
| 903,000 | A | 11/1908 | Priest, Jr. | |
| 1,014,157 | A * | 1/1912 | Lewen | 52/326 |
| 1,170,419 | A | 2/1916 | Coon et al. | |

(Continued)

FOREIGN PATENT DOCUMENTS

| | | |
|---|---|---|
| CH | 279209 | 3/1952 |
| EP | 0199595 B1 | 3/1995 |

(Continued)

OTHER PUBLICATIONS

ASTM Standard A-951, Standard Specification for Steel Wire for Masonry Joint Reinforcement, Nov. 14, 2011, Table 1, 6 pages, West Conshohocken, Pennsylvania, United States.

(Continued)

*Primary Examiner* — Brian Glessner
*Assistant Examiner* — Brian D Mattei
(74) *Attorney, Agent, or Firm* — Silber & Fridman

(57) ABSTRACT

A dovetail anchoring system for cavity walls is disclosed and includes a sheetmetal dovetail anchor and one-piece sheetmetal dovetail veneer tie. The anchoring system is used in conjunction with building structures that have a masonry outer wythe anchored to a poured masonry inner wythe. A thermally-isolating coating is optionally applied to the high-strength veneer tie, which is interconnected with the wall anchor. The thermally-isolating coating is selected from a distinct grouping of materials, that are applied using a specific variety of methods, in one or more layers and cured and cross-linked to provide high-strength adhesion. The thermally-coated veneer ties provide an in-cavity thermal break that severs the thermal threads running throughout the cavity wall structure, reducing the U- and K-values of the anchoring system by thermally-isolating the metal components.

18 Claims, 5 Drawing Sheets

(56) References Cited

U.S. PATENT DOCUMENTS

| | | | | | |
|---|---|---|---|---|---|
| RE15,979 | E | * | 1/1925 | Schaefer et al. | 52/379 |
| 1,794,684 | A | | 3/1931 | Handel | |
| 1,936,223 | A | * | 11/1933 | Awbrey | 52/562 |
| 2,058,148 | A | | 10/1936 | Hard | |
| 2,097,821 | A | | 11/1937 | Mathers | |
| 2,280,647 | A | | 4/1942 | Hawes | |
| 2,300,181 | A | | 10/1942 | Spaight | |
| 2,403,566 | A | | 7/1946 | Thorp et al. | |
| 2,413,772 | A | | 1/1947 | Morehouse | |
| 2,605,867 | A | | 8/1952 | Goodwin | |
| 2,780,936 | A | | 2/1957 | Hillberg | |
| 2,898,758 | A | * | 8/1959 | Henrickson | 52/710 |
| 2,929,238 | A | | 3/1960 | Kaye | |
| 2,966,705 | A | | 1/1961 | Massey | |
| 2,999,571 | A | | 9/1961 | Huber | |
| 3,030,670 | A | | 4/1962 | Bigelow | |
| 3,183,628 | A | | 5/1965 | Smith | |
| 3,254,736 | A | | 6/1966 | Gass | |
| 3,277,626 | A | | 10/1966 | Brynjolfsson et al. | |
| 3,300,939 | A | | 1/1967 | Brynjolfsson et al. | |
| 3,309,828 | A | | 3/1967 | Tribble | |
| 3,310,926 | A | | 3/1967 | Brandreth et al. | |
| 3,341,998 | A | | 9/1967 | Lucas | |
| 3,377,764 | A | | 4/1968 | Storch | |
| 3,478,480 | A | | 11/1969 | Swenson | |
| 3,563,131 | A | | 2/1971 | Ridley, Sr. | |
| 3,568,389 | A | | 3/1971 | Gulow | |
| 3,640,043 | A | | 2/1972 | Querfeld et al. | |
| 3,964,226 | A | | 6/1976 | Hala et al. | |
| 3,964,227 | A | | 6/1976 | Hala | |
| 4,021,990 | A | | 5/1977 | Schwalberg | |
| 4,227,359 | A | | 10/1980 | Schlenker | |
| 4,238,987 | A | | 12/1980 | Siebrecht-Reuter | |
| 4,305,239 | A | | 12/1981 | Geraghty | |
| 4,373,314 | A | | 2/1983 | Allan | |
| 4,382,416 | A | | 5/1983 | Kellogg-Smith | |
| 4,424,745 | A | | 1/1984 | Magorian et al. | |
| 4,438,611 | A | | 3/1984 | Bryant | |
| 4,473,984 | A | | 10/1984 | Lopez | |
| 4,482,368 | A | | 11/1984 | Roberts | |
| 4,571,909 | A | | 2/1986 | Berghuis et al. | |
| 4,596,102 | A | | 6/1986 | Catani et al. | |
| 4,598,518 | A | | 7/1986 | Hohmann | |
| 4,606,163 | A | | 8/1986 | Catani | |
| 4,622,796 | A | * | 11/1986 | Aziz et al. | 52/747.12 |
| 4,628,657 | A | | 12/1986 | Ermer et al. | |
| 4,636,125 | A | | 1/1987 | Burgard | |
| 4,640,848 | A | | 2/1987 | Cerdan-Diaz et al. | |
| 4,660,342 | A | | 4/1987 | Salisbury | |
| 4,703,604 | A | | 11/1987 | Muller | |
| 4,708,551 | A | | 11/1987 | Richter et al. | |
| 4,738,070 | A | | 4/1988 | Abbott et al. | |
| 4,764,069 | A | | 8/1988 | Reinwall et al. | |
| 4,819,401 | A | | 4/1989 | Whitney, Jr. | |
| 4,827,684 | A | | 5/1989 | Allan | |
| 4,843,776 | A | | 7/1989 | Guignard | |
| 4,852,320 | A | | 8/1989 | Ballantyne | |
| 4,869,038 | A | | 9/1989 | Catani | |
| 4,869,043 | A | | 9/1989 | Hatzinikolas et al. | |
| 4,875,319 | A | | 10/1989 | Hohmann | |
| 4,911,949 | A | | 3/1990 | Iwase et al. | |
| 4,922,680 | A | | 5/1990 | Kramer et al. | |
| 4,946,632 | A | | 8/1990 | Pollina | |
| 4,955,172 | A | | 9/1990 | Pierson | |
| 5,063,722 | A | | 11/1991 | Hohmann | |
| 5,099,628 | A | | 3/1992 | Noland et al. | |
| 5,207,043 | A | | 5/1993 | McGee et al. | |
| 5,307,602 | A | | 5/1994 | Lebraut | |
| 5,392,581 | A | | 2/1995 | Hatzinikolas et al. | |
| 5,408,798 | A | | 4/1995 | Hohmann | |
| 5,440,854 | A | | 8/1995 | Hohmann | |
| 5,454,200 | A | | 10/1995 | Hohmann | |
| 5,456,052 | A | | 10/1995 | Anderson et al. | |
| 5,490,366 | A | | 2/1996 | Burns et al. | |
| 5,598,673 | A | | 2/1997 | Atkins | |
| 5,634,310 | A | | 6/1997 | Hohmann | |
| 5,669,592 | A | | 9/1997 | Kearful | |
| 5,671,578 | A | | 9/1997 | Hohmann | |
| 5,673,527 | A | | 10/1997 | Coston et al. | |
| 5,755,070 | A | | 5/1998 | Hohmann | |
| 5,816,008 | A | | 10/1998 | Hohmann | |
| 5,819,486 | A | | 10/1998 | Goodings | |
| 5,845,455 | A | | 12/1998 | Johnson, III | |
| 6,000,178 | A | | 12/1999 | Goodings | |
| 6,125,608 | A | | 10/2000 | Charlson | |
| 6,209,281 | B1 | | 4/2001 | Rice | |
| 6,279,283 | B1 | | 8/2001 | Hohmann et al. | |
| 6,284,311 | B1 | | 9/2001 | Gregorovich et al. | |
| 6,332,300 | B1 | | 12/2001 | Wakai | |
| 6,351,922 | B1 | | 3/2002 | Burns et al. | |
| 6,367,219 | B1 | | 4/2002 | Quinlan | |
| 6,612,343 | B2 | | 9/2003 | Camberlin et al. | |
| 6,627,128 | B1 | | 9/2003 | Boyer | |
| 6,668,505 | B1 | | 12/2003 | Hohmann et al. | |
| 6,686,301 | B2 | | 2/2004 | Li et al. | |
| 6,735,915 | B1 | | 5/2004 | Johnson, III | |
| 6,739,105 | B2 | | 5/2004 | Fleming | |
| 6,789,365 | B1 | | 9/2004 | Hohmann et al. | |
| 6,817,147 | B1 | | 11/2004 | MacDonald | |
| 6,827,969 | B1 | | 12/2004 | Skoog et al. | |
| 6,837,013 | B2 | | 1/2005 | Foderberg et al. | |
| 6,851,239 | B1 | | 2/2005 | Hohmann et al. | |
| 6,925,768 | B2 | | 8/2005 | Hohmann et al. | |
| 6,941,717 | B2 | | 9/2005 | Hohmann et al. | |
| 6,968,659 | B2 | | 11/2005 | Boyer | |
| 7,007,433 | B2 | | 3/2006 | Boyer | |
| 7,017,318 | B1 | | 3/2006 | Hohmann et al. | |
| 7,043,884 | B2 | | 5/2006 | Moreno | |
| 7,059,577 | B1 | | 6/2006 | Burgett | |
| D527,834 | S | | 9/2006 | Thimons | |
| 7,147,419 | B2 | | 12/2006 | Balbo Di Vinadio | |
| 7,152,382 | B2 | | 12/2006 | Johnson, III | |
| 7,171,788 | B2 | | 2/2007 | Bronner | |
| 7,178,299 | B2 | | 2/2007 | Hyde et al. | |
| D538,948 | S | | 3/2007 | Thimons et al. | |
| 7,225,590 | B1 | | 6/2007 | diGirolamo et al. | |
| 7,325,366 | B1 | | 2/2008 | Hohmann, Jr. et al. | |
| 7,334,374 | B2 | | 2/2008 | Schmid | |
| 7,374,825 | B2 | | 5/2008 | Hazel et al. | |
| 7,415,803 | B2 | | 8/2008 | Bronner | |
| 7,469,511 | B2 | * | 12/2008 | Wobber | 52/474 |
| 7,481,032 | B2 | | 1/2009 | Tarr | |
| 7,552,566 | B2 | | 6/2009 | Hyde et al. | |
| 7,562,506 | B2 | | 7/2009 | Hohmann, Jr. | |
| 7,587,874 | B2 | | 9/2009 | Hohmann, Jr. | |
| 7,735,292 | B2 | | 6/2010 | Massie | |
| 7,748,181 | B1 | | 7/2010 | Guinn | |
| 7,788,869 | B2 | | 9/2010 | Voegele, Jr. | |
| D626,817 | S | | 11/2010 | Donowho et al. | |
| 7,845,137 | B2 | | 12/2010 | Hohmann, Jr. | |
| 8,037,653 | B2 | | 10/2011 | Hohmann, Jr. | |
| 8,051,619 | B2 | | 11/2011 | Hohmann, Jr. | |
| 8,096,090 | B1 | | 1/2012 | Hohmann, Jr. et al. | |
| 8,109,706 | B2 | | 2/2012 | Richards | |
| 8,122,663 | B1 | | 2/2012 | Hohmann, Jr. et al. | |
| 8,201,374 | B2 | | 6/2012 | Hohmann, Jr. | |
| 8,209,934 | B2 | | 7/2012 | Pettingale | |
| 8,215,083 | B2 | | 7/2012 | Toas et al. | |
| 8,291,672 | B2 | | 10/2012 | Hohmann, Jr. | |
| 8,347,581 | B2 | | 1/2013 | Doerr et al. | |
| 8,375,667 | B2 | | 2/2013 | Hohmann, Jr. | |
| 8,418,422 | B2 | | 4/2013 | Johnson, III | |
| 8,511,041 | B2 | | 8/2013 | Fransen | |
| 8,516,763 | B2 | | 8/2013 | Hohmann, Jr. | |
| 8,516,768 | B2 | | 8/2013 | Johnson, III | |
| 8,544,228 | B2 | | 10/2013 | Bronner | |
| 8,555,587 | B2 | | 10/2013 | Hohmann, Jr. | |
| 8,555,596 | B2 | | 10/2013 | Hohmann, Jr. | |
| 8,596,010 | B2 | | 12/2013 | Hohmann, Jr. | |
| 8,613,175 | B2 | | 12/2013 | Hohmann, Jr. | |
| 8,667,757 | B1 | | 3/2014 | Hohmann, Jr. | |
| 2001/0054270 | A1 | | 12/2001 | Rice | |
| 2002/0100239 | A1 | | 8/2002 | Lopez | |
| 2003/0121226 | A1 | | 7/2003 | Bolduc | |

(56) References Cited

U.S. PATENT DOCUMENTS

| | | | | |
|---|---|---|---|---|
| 2003/0217521 | A1 | 11/2003 | Richardson et al. | |
| 2004/0083667 | A1 | 5/2004 | Johnson, III | |
| 2004/0216408 | A1 | 11/2004 | Hohmann, Jr. | |
| 2004/0216413 | A1 | 11/2004 | Hohmann et al. | |
| 2004/0216416 | A1 | 11/2004 | Hohmann et al. | |
| 2004/0231270 | A1 | 11/2004 | Collins et al. | |
| 2005/0279043 | A1 | 12/2005 | Bronner | |
| 2006/0198717 | A1 | 9/2006 | Fuest | |
| 2006/0242921 | A1 | 11/2006 | Massie | |
| 2006/0251916 | A1 | 11/2006 | Arikawa et al. | |
| 2007/0011964 | A1* | 1/2007 | Smith | 52/285.3 |
| 2008/0092472 | A1 | 4/2008 | Doerr et al. | |
| 2008/0141605 | A1 | 6/2008 | Hohmann | |
| 2008/0222992 | A1 | 9/2008 | Hikai et al. | |
| 2009/0133351 | A1 | 5/2009 | Wobber | |
| 2009/0133357 | A1 | 5/2009 | Richards | |
| 2010/0037552 | A1 | 2/2010 | Bronner | |
| 2010/0071307 | A1 | 3/2010 | Hohmann, Jr. | |
| 2010/0101175 | A1 | 4/2010 | Hohmann | |
| 2010/0192495 | A1 | 8/2010 | Huff et al. | |
| 2010/0257803 | A1 | 10/2010 | Hohmann, Jr. | |
| 2011/0023748 | A1 | 2/2011 | Wagh et al. | |
| 2011/0041442 | A1 | 2/2011 | Bui | |
| 2011/0047919 | A1 | 3/2011 | Hohmann, Jr. | |
| 2011/0061333 | A1 | 3/2011 | Bronner | |
| 2011/0083389 | A1 | 4/2011 | Bui | |
| 2011/0146195 | A1 | 6/2011 | Hohmann, Jr. | |
| 2011/0173902 | A1 | 7/2011 | Hohmann, Jr. et al. | |
| 2011/0277397 | A1 | 11/2011 | Hohmann, Jr. | |
| 2012/0186183 | A1 | 7/2012 | Johnson, III | |
| 2012/0285111 | A1* | 11/2012 | Johnson, III | 52/379 |
| 2012/0304576 | A1 | 12/2012 | Hohmann, Jr. | |
| 2012/0308330 | A1 | 12/2012 | Hohmann, Jr. | |
| 2013/0008121 | A1 | 1/2013 | Dalen | |
| 2013/0074435 | A1 | 3/2013 | Hohmann, Jr. | |
| 2013/0232893 | A1 | 9/2013 | Hohmann, Jr. | |
| 2013/0232909 | A1 | 9/2013 | Curtis et al. | |
| 2013/0247482 | A1 | 9/2013 | Hohmann, Jr. | |
| 2013/0247483 | A1 | 9/2013 | Hohmann, Jr. | |
| 2013/0247484 | A1 | 9/2013 | Hohmann, Jr. | |
| 2013/0247498 | A1 | 9/2013 | Hohmann, Jr. | |
| 2013/0340378 | A1 | 12/2013 | Hohmann, Jr. | |
| 2014/0000211 | A1 | 1/2014 | Hohmann, Jr. | |
| 2014/0075855 | A1 | 3/2014 | Hohmann, Jr. | |
| 2014/0075856 | A1 | 3/2014 | Hohmann, Jr. | |
| 2014/0075879 | A1 | 3/2014 | Hohmann, Jr. | |
| 2014/0096466 | A1 | 4/2014 | Hohmann, Jr. | |
| 2014/0174013 | A1 | 6/2014 | Hohmann, Jr. et al. | |

FOREIGN PATENT DOCUMENTS

| | | |
|---|---|---|
| GB | 1575501 | 9/1980 |
| GB | 2069024 A | 8/1981 |
| GB | 2246149 A | 1/1992 |
| GB | 2265164 A | 9/1993 |
| GB | 2459936 B | 3/2013 |

OTHER PUBLICATIONS

State Board of Building Regulations and Standards, Building Envelope Requirements, 780 CMR sec. 1304.0 et seq., 7th Edition, Aug. 22, 2008, 11 pages, Boston, MA, United States.

Hohmann & Barnard, Product Catalog, 44 pgs (2003).

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

Building Envelope Requirements for Commercial and High Rise Residential Buildings, 780 CMR sec. 1304.0 et seq. of Chapter 13, Jan. 1, 2001, 19 pages, Boston, Massachusetts, United States.

Building Code Requirements for Masonry Structures, TMS 402-11/ACI 530-11/ASCE 5-11, Chapter 6, 12 pages.

Hohmann & Barnard, Inc.; Product Catalog, 2013, 52 pages, Hauppauge, New York, United States.

Effect of Insulation and Mass Distribution in Exterior Walls on Dynamic Thermal Performance of Whole Buildings, Jan Kosny, Ph.D, Elisabeth Kossecka, Ph.D., Thermal Envelopes VII/Building Systems—Principles p. 721-731, 11 pages.

* cited by examiner

ONE-PIECE DOVETAIL VENEER TIE AND WALL ANCHORING SYSTEM WITH IN-CAVITY THERMAL BREAKS

BACKGROUND OF THE INVENTION

1. Field of the Invention

This invention relates to an improved anchoring arrangement for use in conjunction with building structures having a masonry construction outer wythe anchored to a masonry inner wythe with a dovetail slot anchor secured therewithin. More particularly, the invention relates to an anchoring system that interconnects with a one-piece dovetail veneer tie. The one-piece dovetail tie is designed to receive a thermal coating. The invention is applicable to seismic-resistant structures as well as to structures requiring insulation.

2. Description of the Prior Art

The present invention simplifies installation of a veneer anchoring system by reducing the number of parts required for production and installation at the worksite. Additionally, the one-piece nature of the veneer tie provides high-strength support by removing the separate interconnection component of the dovetail anchoring system, a common source of veneer tie failure. Further, the dovetail tail is designed to receive a thermal coating, thereby providing thermal isolation within the wall and providing an energy efficient anchoring system.

In the past, investigations relating to the effects of various forces, particularly lateral forces, upon brick veneer masonry construction demonstrated the advantages of having high-strength anchoring components embedded in the bed joints of anchored veneer walls, such as facing brick or stone veneer. Anchors and ties are generally placed in one of the following five categories: corrugated; sheet metal; wire; two-piece adjustable; or joint reinforcing. The present invention has a focus on sheet metal veneer ties.

While anchoring systems have taken a variety of configurations, where the applications included masonry inner wythes, wall anchors were commonly incorporated into ladder—or truss-type reinforcements and provided wire-to-wire connections with box-ties or pintle-receiving designs on the veneer side. In the late 1980's, surface-mounted wall anchors were developed by Hohmann & Barnard, Inc., now a MiTEK-Berkshire Hathaway Company, and patented under U.S. Pat. No. 4,598,518. The invention was commercialized under trademarks DW-10®, DW-10-X®, and DW-10-HS®. These widely accepted building specialty products were designed primarily for dry-wall construction, but were also used with masonry inner wythes. For seismic applications, it was common practice to use these wall anchors as part of the DW-10® Seismiclip® interlock system which added a Byna-Tie® wire formative, a Seismiclip® snap-in device—described in U.S. Pat. No. 4,875,319 ('319), and a continuous wire reinforcement.

In an insulated dry wall application, the surface-mounted wall anchor of the above-described system has pronged legs that pierce the insulation and the wallboard and rest against the metal stud to provide mechanical stability in a four-point landing arrangement. The vertical slot of the wall anchor enables the mason to have the wire tie adjustably positioned along a pathway of up to 3.625-inch (max.). The interlock system served well and received high scores in testing and engineering evaluations which examined effects of various forces, particularly lateral forces, upon brick veneer masonry construction. However, under certain conditions, the system did not sufficiently maintain the integrity of the insulation.

The engineering evaluations further described the advantages of having a continuous wire embedded in the mortar joint of anchored veneer wythes. The seismic aspects of these investigations were reported in the inventor's '319 patent. Besides earthquake protection, the failure of several high-rise buildings to withstand wind and other lateral forces resulted in the incorporation of a continuous wire reinforcement requirement in the Uniform Building Code provisions. The use of a continuous wire in masonry veneer walls has also been found to provide protection against problems arising from thermal expansion and contraction and to improve the uniformity of the distribution of lateral forces in the structure.

Shortly after the introduction of the pronged wall anchor, a seismic veneer anchor, which incorporated an L-shaped backplate, was introduced. This was formed from either 12- or 14-gauge sheetmetal and provided horizontally disposed openings in the arms thereof for pintle legs of the veneer anchor. In general, the pintle-receiving sheetmetal version of the Seismiclip interlock system served well, but in addition to the insulation integrity problem, installations were hampered by mortar buildup interfering with pintle leg insertion.

In the 1980's, an anchor for masonry veneer walls was developed and described in U.S. Pat. No. 4,764,069 by Reinwall et al., which patent is an improvement of the masonry veneer anchor of Lopez, U.S. Pat. No. 4,473,984. Here the anchors are keyed to elements that are installed using power-rotated drivers to deposit a mounting stud in a cementitious or masonry inner wythe. Fittings are then attached to the stud, which include an elongated eye and a wire tie therethrough for disposition in a bed joint of the outer wythe. It is instructive to note that pin-point loading—that is forces concentrated at substantially a single point—developed from this design configuration. Upon experiencing lateral forces over time, this resulted in the loosening of the stud.

In the past, the use of wire formatives have been limited by the mortar layer thickness which, in turn are dictated either by the new building specifications or by pre-existing conditions, e.g. matching during renovations or additions to the existing mortar layer thickness. While arguments have been made for increasing the number of the fine-wire anchors per unit area of the facing layer, architects and architectural engineers have favored wire formative anchors of sturdier wire.

Contractors found that heavy wire anchors, with diameters approaching the mortar layer height specification, frequently result in misalignment. This led to the low-profile wall anchors of the inventors hereof as described in U.S. Pat. No. 6,279,283. However, the above-described technology did not fully address the adaption thereof to insulated inner wythes utilizing stabilized stud-type devices.

There have been significant shifts in public sector building specifications, such as the Energy Code Requirement, Boston, Mass. (see Chapter 13 of 780 CMR, Seventh Edition). This Code sets forth insulation R-values well in excess of prior editions and evokes an engineering response opting for thicker insulation and correspondingly larger cavities. Here, the emphasis is upon creating a building envelope that is designed and constructed with a continuous air barrier to control air leakage into or out of conditioned space adjacent the inner wythe, which have resulted in architects and architectural engineers requiring larger and larger cavities in the exterior cavity walls of public buildings. These requirements are imposed without corresponding decreases in wind shear and seismic resistance levels or increases in mortar bed joint height. Thus, wall anchors are needed to occupy the same ⅜-inch high space in the inner wythe and tie down a veneer facing material of an outer wythe at a span of two or more times that which had previously been experienced.

As insulation became thicker, the tearing of insulation during installation of the pronged DW-10X® wall anchor, see infra, became more prevalent. This occurred as the installer would fully insert one side of the wall anchor before seating the other side. The tearing would occur at two times, namely, during the arcuate path of the insertion of the second leg and separately upon installation of the attaching hardware. The gapping caused in the insulation permitted air and moisture to infiltrate through the insulation along the pathway formed by the tear. While the gapping was largely resolved by placing a self-sealing, dual-barrier polymeric membrane at the site of the legs and the mounting hardware, with increasing thickness in insulation, this patchwork became less desirable.

The high-strength veneer tie of this invention is specially configured to prevent veneer tie failure and resultant pullout. The configured tie restricts pull out and horizontal movement while allowing adjustment in the vertical direction, ensuring a high-strength connection and transfer of forces between the outer wythe and the inner wythe.

The move toward more energy-efficient insulated cavity wall structures has led to the need to create a thermally isolated building envelope which separates the interior environment and the exterior environment of a cavity wall structure. The building envelope is designed to control temperature, thermal transfer between the wythes and moisture development, while maintaining structural integrity. Thermal insulation is used within the building envelope to maintain temperature and therefore restrict the formation of condensation within the cavity. The integrity of the thermal insulation is compromised when used in conjunction with the prior art metal anchoring system, which are constructed from thermally conductive metals that cause thermal transfer between and through the wythes. The use of the specially designed and thermally-protected veneer ties of the present invention lower the metal thermal conductivities and thereby reduce thermal transfer.

When a cavity wall is constructed and a thermal envelope created, hundreds, if not thousands, of wall anchors and associated ties are inserted throughout the cavity wall. Each anchor and tie combination forms a thermal bridge, perforating the insulation and moisture barriers within the cavity wall structure. While seals at the insertion locations can deter water and vapor entry, thermal transfer and loss still result. Further, when each individual anchoring systems is interconnected veneer-tie-to-wall-anchor, a thermal thread results stretching across the cavity and extending between the inner wythe and the outer wythe. Failure to isolate the steel components and break the thermal transfer, results in heating and cooling losses and potentially damaging condensation buildup within the cavity wall structure. Such buildups provide a medium for corrosion and mold growth. The use of a thermally-isolating coated veneer tie removes the thermal bridges and breaks the thermal thread resulting in a thermally-isolated anchoring system and resulting lower heat loss within the building envelope.

The present invention provides a thermally-isolating coated veneer tie specially-suited for use within a cavity wall. Anchoring systems within cavity walls are subject to outside forces such as earthquakes and wind shear that cause abrupt movement within the cavity wall. Additionally, any materials placed within the cavity wall require the characteristics of low flammability and, upon combustion, the release of combustion products with low toxicity. The present invention provides a coating suited to such requirements, which, besides meeting the flammability/toxicity standards, includes characteristics such as shock resistance, non-frangibility, low thermal conductivity and transmissivity, and a non-porous resilient finish. This unique combination of characteristics provides a veneer tie well-suited for installation within a cavity wall anchoring system.

As concerns for thermal transfer and resulting heat loss/gain and the buildup of condensation within the cavity wall grew, focus turned to thermal isolation and breaks. Another prior art development occurred in an attempt to address thermal transfer shortly after that of Reinwall/Lopez when Hatzinikolas and Pacholok of Fero Holding Ltd. introduced their sheetmetal masonry connector for a cavity wall. This device is described in U.S. Pat. Nos. 5,392,581 and 4,869,043. Here a sheetmetal plate connects to the side of a dry wall column and protrudes through the insulation into the cavity. A wire tie is threaded through a slot in the leading edge of the plate capturing an insulative plate thereunder and extending into a bed joint of the outer wythe. The underlying sheetmetal plate is highly thermally conductive, and the '581 patent describes lowering the thermal conductivity by foraminously structuring the plate. However, as there is no thermal break, a concomitant loss of the insulative integrity results. Further reductions in thermal transfer were accomplished through the Byna-Tie® system ('319) which provides a bail handle with pointed legs and a dual sealing arrangement, U.S. Pat. No. 8,037,653. While each prior art invention focused on reducing thermal transfer, neither development provided more complete thermal protection through the use of a specialized thermally-isolating coated veneer tie, which removes thermal bridging and improves thermal insulation through the use of a thermal barrier. The presently presented thermal tie is optionally provided with a matte-finish coating to provide pullout resistance.

Focus on the thermal characteristics of cavity wall construction is important to ensuring minimized heat transfer through the walls, both for comfort and for energy efficiency of heating and air conditioning. When the exterior is cold relative to the interior of a heated structure, heat from the interior should be prevented from passing through the outside. Similarly, when the exterior is hot relative to the interior of an air conditioned structure, heat from the exterior should be prevented from passing through to the interior. The main cause of thermal transfer is the use of anchoring systems made largely of metals that are thermally conductive. While providing the required high-strength within the cavity wall system, the use of steel components results in heat transfer.

Another application for anchoring systems is in the evolving technology of self-cooling buildings. Here, the cavity wall serves additionally as a plenum for delivering air from one area to another. The ability to size cavities to match air moving requirements for naturally ventilated buildings enable the architectural engineer to now consider cavity walls when designing structures in this environmentally favorable form.

Building thermal stability within a cavity wall system requires the ability to hold the internal temperature of the cavity wall within a certain interval. This ability helps to prevent the development of cold spots, which act as gathering points for condensation. Through the use of a thermally-isolating coating, the underlying metal veneer tie obtains a lower transmission (U-value) and thermal conductive value (K-value) and provides non-corrosive benefits. The present invention maintains the strength of the metal and further provides the benefits of a thermal break in the cavity.

In the course of preparing this Application, several patents, became known to the inventors hereof and are acknowledged hereby:

| Pat. | Inventor | Issue Date |
|---|---|---|
| 4,373,314 | Allan | Feb. 15, 1983 |
| 4,869,038 | Catani | Sep. 26, 1989 |
| 5,063,722 | Hohmann | Nov. 12, 1991 |
| 5,392,581 | Hatzinikolas, et al. | Feb. 28, 1995 |
| 5,456,052 | Anderson et al. | Oct. 10, 1995 |
| 5,671,578 | Hohmann | Sep. 30, 1997 |
| 6,125,608 | Charlson | Oct. 3, 2000 |
| 7,325,366 | Hohmann, Jr., et al. | Feb. 5, 2008 |
| 8,109,706 | Richards | Feb. 7, 2012 |
| 8,122,663 | Hohmann, Jr., et al. | Feb. 28, 2012 |

U.S. Pat. No. 4,373,314—Allan—Issued Feb. 15, 1983

Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,869,038—Catani—Issued Sep. 26, 1989

Discloses a veneer wall anchoring system that interconnects a backup wall of block construction with a brick veneer wall. A wall of rigid insulation is placed against an outer face of the backup wall with the plates extending through the insulation. The plate includes a spring clip fastener which engages the insulation wall.

U.S. Pat. No. 5,063,722—Hohmann—Issued Nov. 12, 1991

Discloses a gripstay channel veneer anchor assembly that engages an insulation layer and the inner wythe. A clip securement projects through the channel, pierces the insulation and engages the support member.

U.S. Pat. No. 5,392,581—Hatzinikolas et al.—Issued Feb. 28, 1995

Discloses a cavity-wall anchor having a conventional tie wire for mounting in the brick veneer and an L-shaped sheetmetal bracket for mounting vertically between side-by-side blocks and horizontally atop a course of blocks. The bracket has a slit which is vertically disposed and protrudes into the cavity. The slit provides for a vertically adjustable anchor.

U.S. Pat. No. 5,456,052—Anderson et al.—Issued Oct. 10, 1995

Discloses a two-part masonry brick tie, the first part being designed to be installed in the inner wythe and then, later when the brick veneer is erected to be interconnected by the second part. Both parts are constructed from sheetmetal and are arranged on substantially the same horizontal plane.

U.S. Pat. No. 5,671,578—Hohmann—Issued Sep. 30, 1997

Discloses a surface-mounted seismic construction system. The system includes a wire formative anchor and box tie. The anchor includes a seismic clip and reinforcement wire and the anchor eye portions are oriented to secure the insulation panels which are protected by insulation shields U.S. Pat. No. 7,325,366—Hohmann, Jr. et al.—Issued Feb. 5, 2008

Discloses snap-in veneer ties for a seismic construction system in cooperation with low-profile, high-span wall anchors.

U.S. Pat. No. 6,125,608—Charlson—Issued Oct. 3, 2000

Discloses a composite insulated framing system within a structural building system. The Charlson system includes an insulator adhered to the structural support through the use of adhesives, frictional forces or mechanical fasteners to disrupt thermal activity.

U.S. Pat. No. 8,109,706—Richards—Issued Feb. 7, 2012

Discloses a composite fastener, belly nut and tie system for use in a building envelope. The composite fastener includes a fiber reinforced polymer. The fastener has a low thermal conductive value and non-corrosive properties.

U.S. Pat. No. 8,122,663—Hohmann, Jr. et al.—Issued Feb. 28, 2012

Discloses an anchor and reinforcement device for a cavity wall. The device interlocks with a veneer anchor and veneer reinforcements. The system is composed of wire formatives. The wall anchor and reinforcement devices are compressively reduced in height to span insulation mounted on the exterior of the backup wall.

None of the above references provide the innovations of this invention. As will become clear in reviewing the disclosure which follows, insulated cavity wall structures benefit from the recent developments described herein that lead to solving the problems of veneer tie interconnection failure and maintaining insulation integrity. This invention relates to an improved anchoring arrangement for use in conjunction with cavity walls having a poured concrete masonry inner wythe and a masonry outer wythe and meets the heretofore unmet needs described above.

None of the prior art listed above provides a dovetail channel anchoring system which secures the anchor within the inner wythe and provides a high strength interconnection between the inner wythe and outer wythe. The wall anchor assembly provides a novel one-piece dovetail veneer tie which is readily modifiable to receive a thermally-isolating coating and a seismic reinforcement wire. The prior art does not provide the present novel cavity wall construction system as described herein below.

SUMMARY

In general terms, the invention disclosed hereby is a dovetail anchoring system having a one-piece dovetail veneer tie for use in a cavity wall having a masonry outer wythe and an inner wythe or backup wall of poured concrete. The wall anchor and veneer tie secures the outer wythe to the inner wythe. When the inner wythe includes insulation, the non-invasive high-strength veneer tie does not compromise the insulation integrity. The veneer ties are single constructs comprised of sheet metal and configured for insertion within the wall anchor dovetail channels and the bed joints of the outer wythe. The veneer ties include a seismic notch for interconnection with a reinforcement wire forming a seismic construct. The wall anchor is a sheetmetal device which is interconnected with a thermally-coated sheet metal veneer tie. The veneer tie interconnecting portion is adjustably mounted within the wall anchor dovetail slot.

The veneer tie is a single construct composed of an insertion portion, having a first and a second end, and an interconnecting portion. The first end and optionally, the second end and the interconnecting portion receive a thermally-isolating coating. The thermally-isolating coating is selected from a distinct grouping of materials, that are applied using a specific variety of methods, in one or more layers which are cured and cross-linked to provide high-strength adhesion. A matte finish is provided to form a high-strength, pullout resistant installation in the bed joint. The thermally-coated veneer ties provide an in-cavity thermal break that interrupts the thermal conduction in the anchoring system threads running throughout the cavity wall structure. The thermal coating reduces the U- and K-values of the anchoring system by thermally-isolating the metal components.

It is an object of the present invention to provide new and novel anchoring systems for building structures, which systems are thermally isolating.

It is another object of the present invention to provide a new and novel dovetail anchoring system which includes a one-piece high-strength veneer tie.

It is yet another object of the present invention to provide an anchoring system for a wall having a masonry construction outer wythe anchored to a poured concrete inner wythe.

It is another object of the present invention to provide a new and novel high-strength metal veneer tie which is thermally coated with a thermally-isolating compound that reduces the U- and K-values of the anchoring system.

It is still yet another object of the present invention to provide an anchoring system which is constructed to maintain insulation integrity within the building envelope by providing a thermal break.

It is a feature of the present invention that the wall anchor hereof provides thermal isolation of the anchoring systems.

It is another feature of the present invention that the coated veneer tie provides an in cavity thermal break.

It is another feature of the present invention that the wall anchor is utilizable with a veneer tie that is secured within the bed joints of the outer wythe.

It is another feature of the present invention that the anchoring system is for use with a seismic structure.

Other objects and features of the invention will become apparent upon review of the drawings and the detailed description which follows.

BRIEF DESCRIPTION OF THE DRAWINGS

In the following drawings, the same parts in the various views are afforded the same reference designators.

DESCRIPTION OF THE PREFERRED EMBODIMENTS

Figure 1:
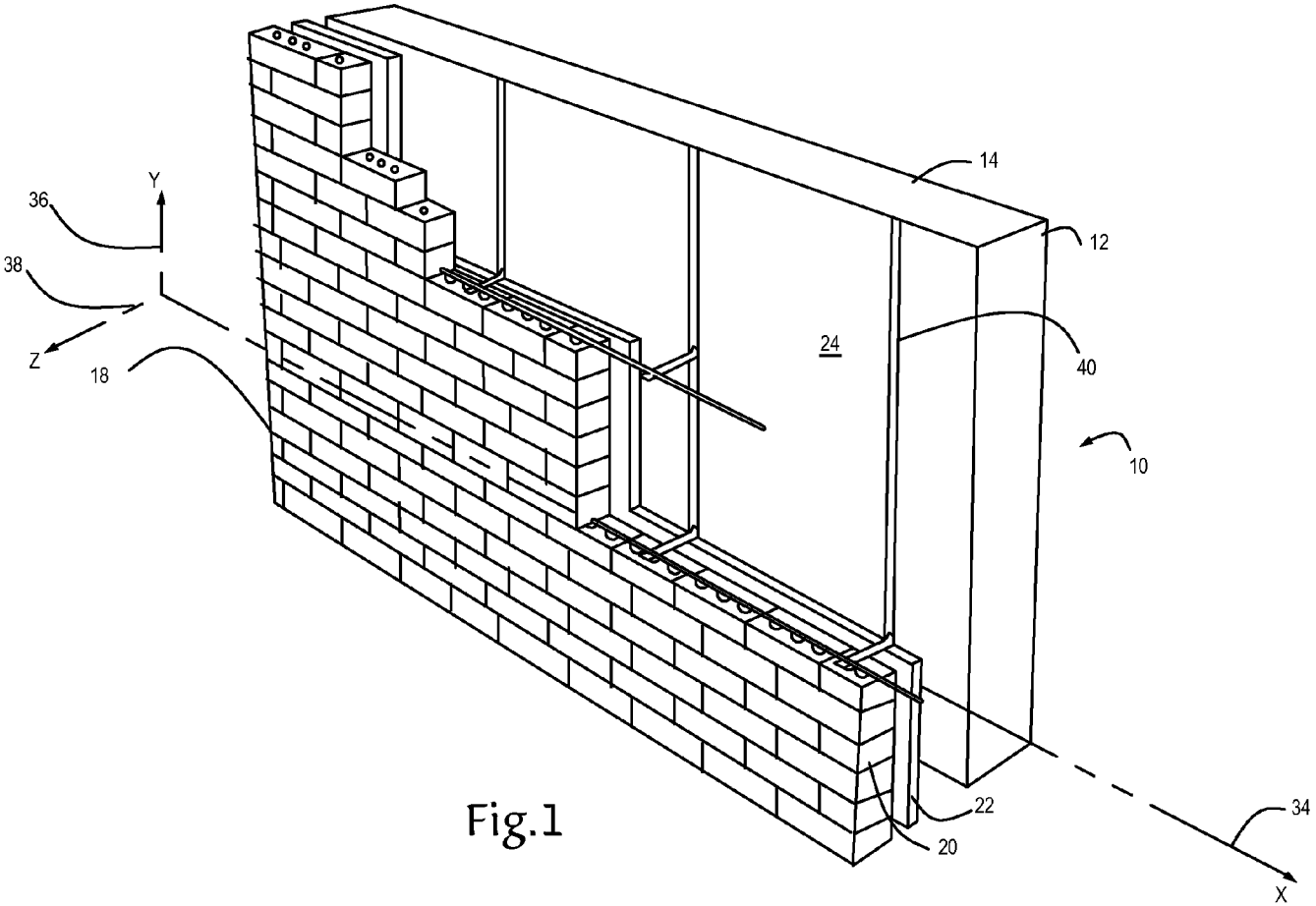
FIG. 1 is a perspective view of this invention with an anchoring system having a dovetail anchor and veneer tie inserted therein, as applied to a cavity wall with an inner wythe of masonry construction with insulation disposed on the cavity-side thereof and an outer wythe of brick.

Before entering into the detailed Description of the Preferred Embodiments, several terms which will be revisited later are defined. These terms are relevant to discussions of innovations introduced by the improvements of this disclosure that overcome the deficits of the prior art devices.

In the embodiments described hereinbelow, the inner wythe is optionally provided with insulation which is applied to the outer surface thereof. Recently, building codes have required that after the anchoring system is installed and, prior to the inner wythe being closed up, that an inspection be made for insulation integrity to ensure that the insulation prevents infiltration of air and moisture. The term as used herein is defined in the same sense as the building code in that, "insulation integrity" means that, after the installation of the anchoring system, there is no change or interference with the insulative properties and concomitantly that there is substantially no change in the air and moisture infiltration characteristics.

Anchoring systems for cavity walls are used to secure veneer facings to buildings and overcome seismic and other forces, i.e. wind shear, etc, while ensuring insulation integrity. In the past, some systems have experienced insulation tearing which results in the loss of insulation integrity. In the present invention, insulation integrity is preserved because the insulation is secured in a non-invasive manner.

In a related sense, prior art sheetmetal anchors have formed a conductive bridge between the wall cavity and the interior of the building. Here the terms thermal conductivity and thermal conductivity analysis are used to examine this phenomenon and the metal-to-metal contacts across the inner wythe. The present anchoring system serves to sever the conductive bridge and interrupt the thermal pathway created throughout the cavity wall by the metal components, including a reinforcement wire which provides a seismic structure. Failure to isolate the metal components of the anchoring system and break the thermal transfer results in heating and cooling losses and in potentially damaging condensation buildup within the cavity wall structure.

In addition to that which occurs at the facing wythe, attention is further drawn to the construction at the exterior surface of the inner or backup wythe. Here there are two concerns, namely (1) maximizing the strength and ease of the securement of the wall anchor to the inner wythe; and, (2) as previously discussed, maintaining the integrity of the insulation. The first concern is addressed by securing the wall anchor within the poured masonry wall. The latter concern is addressed through the use of the novel thermally-isolating non-invasive anchors. In the prior art, the metal anchors and fasteners pierced the insulation causing a loss of insulative integrity.

The thermal stability within the cavity wall maintains the internal temperature within a certain interval. Through the use of the presently described thermally-isolating coating, the underlying metal veneer tie, obtains a lower transmission (U-value) and thermal conductive value (K-value) providing a high-strength anchor with the benefits of thermal isolation. The term K-value is used to describe the measure of heat conductivity of a particular material, i.e., the measure of the amount of heat, in BTUs per hour, that will be transmitted through one square foot of material that is one-inch thick to cause a temperature change of one degree Fahrenheit from one side of the material to the other. The lower the K-value, the better the performance of the material as an insulator. The metal comprising the components of the anchoring systems generally have a K-value range of 16 to 116 W/m K. The thermal coating disposed on the veneer tie of this invention greatly reduces such K-values to a low thermal conductive (K-value) not to exceed 1 W/m K (0.7 W/m K). Similar to the K-value, a low thermal transmission value (U-value) is important to the thermal integrity of the cavity wall. The term U-value is used to describe a measure of heat loss in a building component. It can also be referred to as an overall heat transfer co-efficient and measures how well parts of a building transfer heat. The higher the U-value, the worse the thermal performance of the building envelope. Low thermal transmission or U-value is defined as not to exceed 0.35 $W/m^2K$ for walls. The U-value is calculated from the reciprocal of the combined thermal resistances of the materials in the cavity wall, taking into account the effect of thermal bridges, air gaps and fixings.

Referring now to FIGS. 1 through 6, the first embodiment shows a dovetail anchoring system for use with a masonry inner wythe constructed of poured concrete. This anchoring system, discussed in detail hereinbelow, has a dovetail anchor and a sheetmetal veneer tie interconnected with a reinforcement wire.

The anchoring system for cavity walls is referred to generally by the numeral 10. A cavity wall structure 12 is shown having a masonry inner wythe or masonry backup 14 of poured concrete and an outer wythe or facing 18 of brick 20 or masonry block construction. Between the inner wythe 14 and the outer wythe 18, a cavity 22 is formed. The cavity 22 has attached to the exterior surface 24 of the inner wythe 14 insulation 26. The insulation 26 shown is rigid insulation, but is applicable to other forms including board insulation and spray-on insulation. Optionally, an air/vapor barrier (not shown) is included between the insulation 26 and the exterior surface 24 of the inner wythe 14.

Successive bed joints 30 and 32 are substantially planar and horizontally disposed and, in accord with current building standards, are 0.375-inch (approx.) in height. Selective ones of bed joints 30 and 32, which are formed between courses of bricks 20, are constructed to receive therewithin the insertion portion 50 of the veneer tie 44.

For purposes of discussion, the cavity surface 24 of the inner wythe 14 contains a horizontal line or x-axis 34 and intersecting vertical line or y-axis 36. A horizontal line or z-axis 38, normal to the xy-plane, passes through the coordinate origin formed by the intersecting x- and y-axes 34, 36.

The dovetail anchor 40 is secured within the inner wythe 14 and constructed from a sheetmetal body 41 having two major faces—the mounting surface 43 and the outer surface 45. A dovetail slot 47 is formed from the outer surface 45 of the dovetail anchor 40 and extends the length of the outer surface 45. The dovetail anchor 40 is a metal alloy constructed of material selected from a group consisting of mill galvanized steel, hot-dip galvanized steel, stainless steel, bright basic steel and similar. The dovetail anchor 40 is secured within the poured concrete inner wythe 14.

The veneer tie 44 is constructed from sheet metal and is a single construct. The veneer tie 44 includes an insertion portion 50 having a first end 52 for securement within the outer wythe 18 bed joint 32 and is adjustably mounted within the dovetail slot 47 of the dovetail anchor 40.

Figure 2:
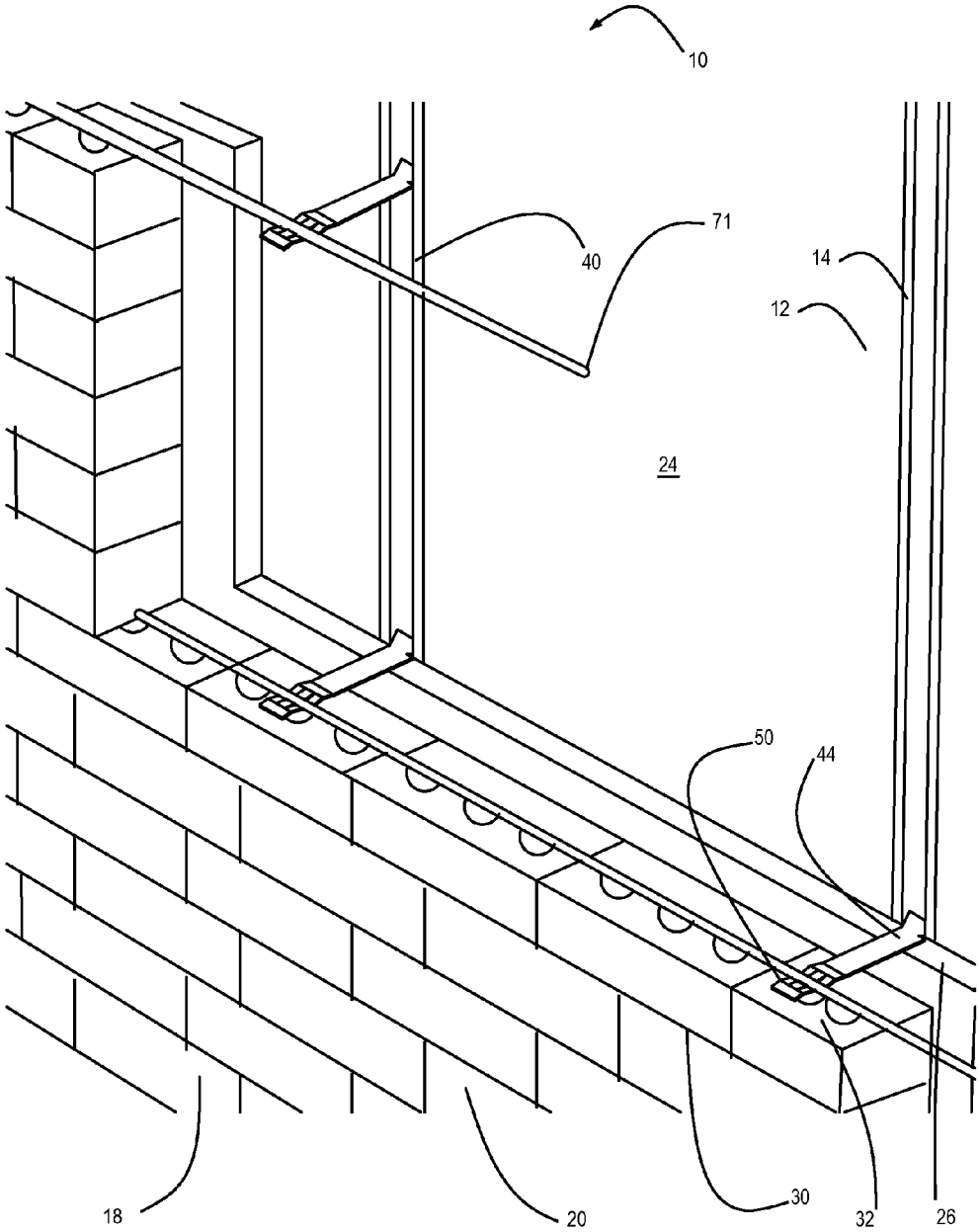
FIG. 2 is an enlarged perspective view of the anchoring system of FIG. 1 showing the veneer tie with a reinforcement wire set therein and secured within the anchor.
Figure 3:
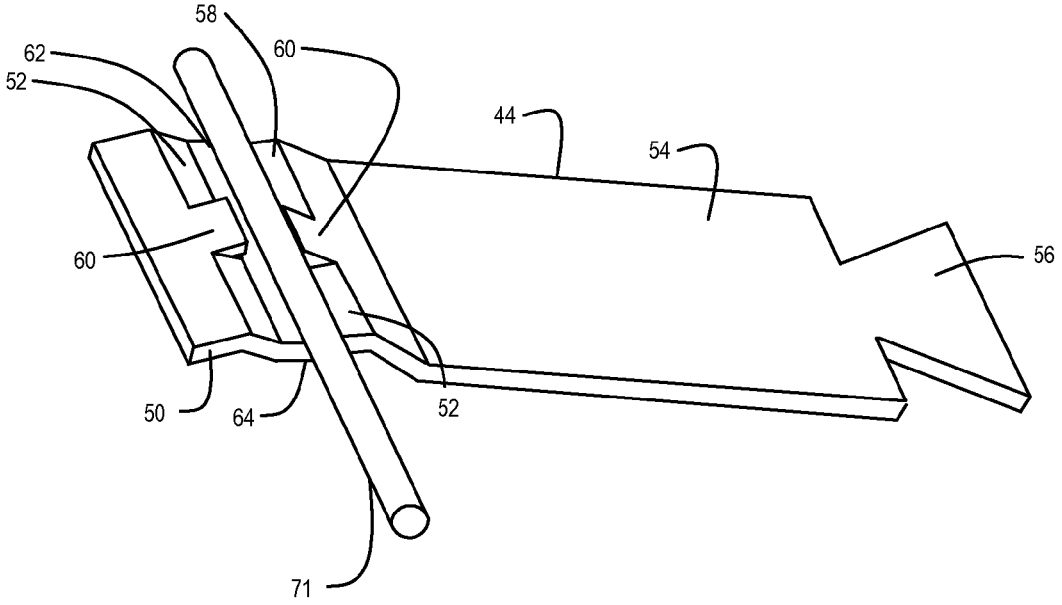
FIG. 3 is a perspective view of the veneer tie of FIG. 1 showing a reinforcement wire set therein.
Figure 4:
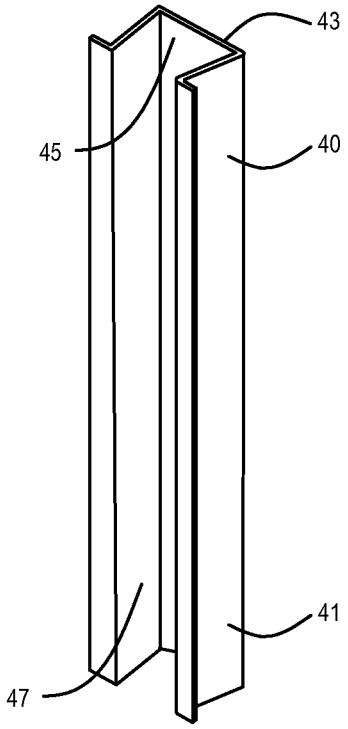
FIG. 4 is a perspective view of the dovetail anchor of FIG. 1.
Figure 5:
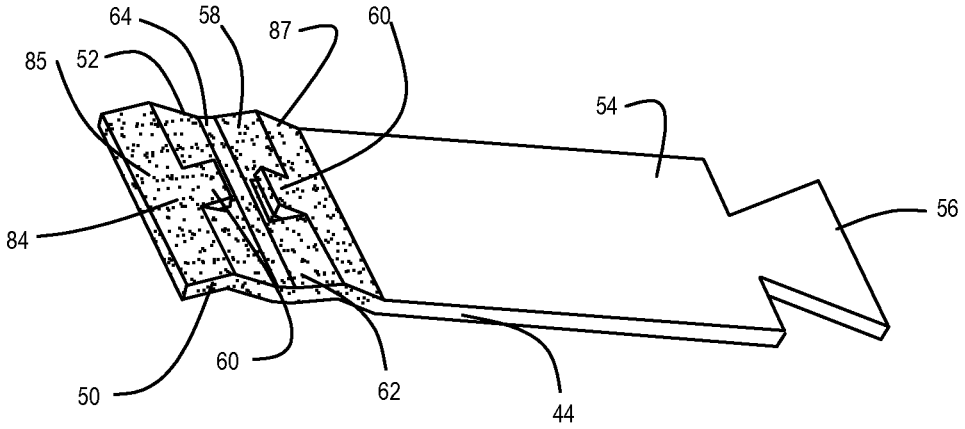
FIG. 5 is a perspective view of an alternative veneer tie having a thermal coating on the insertion portion first end; and, FIG. 6 is a perspective view of an alternative veneer tie having a thermal coating on the entire veneer tie.
Figure 6:
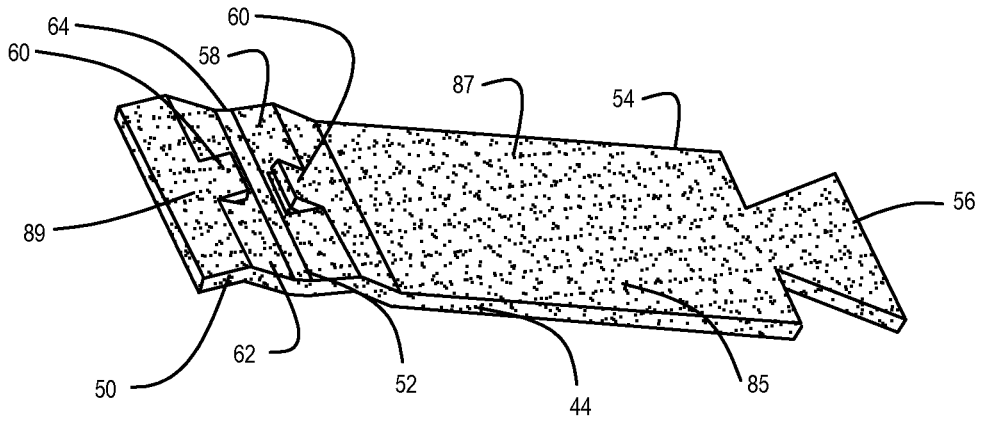

The veneer tie 44 includes an insertion portion 50 having a first end 52 and is shown in FIGS. 1 and 2 as being emplaced on a course of bricks 20 in preparation for embedment in the mortar of bed joint 32, and a second end 54 which lies within the cavity 22. The veneer tie 44 interconnecting portion 56 is contiguous with the second end 54 and adjustably mounted within the dovetail slot 47. A seismic notch 58 is formed from the insertion portion first end 52 and is dimensioned for a snap-fit relationship with a reinforcement wire or outer wythe reinforcement 71, however, the anchoring system 10 is optionally employed without a reinforcement wire 71. The seismic notch 58 includes two securement tabs 60 and a securement depression 62, contiguous with each of the two securement tabs 60 forming a seat 64 to accommodate the reinforcement wire 71. The use of a reinforcement wire 71 forms a seismic construct. The veneer tie 44 is a metal alloy constructed of mill galvanized steel, hot-dip galvanized steel, stainless steel, bright basic steel or similar.

A thermally-isolating coating or thermal coating 85 is applied to the insertion portion first end 52 of the veneer tie 44 to provide a thermal break in the cavity 22, restricting thermal transfer between the veneer tie 44 and the wall anchor 40 and between the wall anchor 40 and the veneer tie 44. The thermal coating 85 is optionally applied to the insertion portion second end 54 and the interconnecting portion 56 to provide ease of coating and additional thermal protection. The thermal coating 85 is selected from thermoplastics, thermosets, natural fibers, rubbers, resins, asphalts, ethylene propylene diene monomers, and admixtures thereof and applied in layers. The thermal coating 85 optionally contains an isotropic polymer which includes, but is not limited to, acrylics, nylons, epoxies, silicones, polyesters, polyvinyl chlorides, and chlorosulfonated polyethelenes. The thermal coating 85 is applied in layers including an initial layer or prime coat 87 of the thermal coating 85 which is cured to provide a precoat and the layers of the thermal coating 85 are cross-linked to provide high-strength adhesion to the veneer tie to resist chipping or wearing of the thermal coating 85.

The thermal coating 85 reduces the K-value and the U-value of the underlying metal components which have K-values that range from 16 to 116 W/m K. The thermal coating 85 reduces the K-value of the veneer tie 44 to not exceed 1.0 W/m K and the associated U-value to not exceed 0.35 $W/m^2K$. The thermal coating 85 is not combustible and gives off no toxic smoke in the event of a fire. Additionally, the thermal coating 85 provides corrosion protection which protects against deterioration of the anchoring system 10 over time.

The thermal coating 85 is applied through any number of methods including fluidized bed production, thermal spraying, hot dip processing, heat-assisted fluid coating, or extrusion, and includes both powder and fluid coating to form a reasonably uniform coating. A coating 85 having a thickness of at least about 5 micrometers is optimally applied. The thermal coating 85 is applied in layers in a manner that provides strong adhesion to the veneer tie 44. The thermal coating 85 is cured to achieve good cross-linking of the layers and has a matte finish 89 to securely hold to the bed joint 32 and increase the strength and pullout resistance of the veneer tie 44. Appropriate examples of the nature of the coating and application process are set forth in U.S. Pat. Nos. 6,284,311 and 6,612,343.

As shown in the description and drawings, the present invention serves to thermally isolate the components of the anchoring system, reducing the thermal transmission and conductivity values of the anchoring system to low levels. The novel coating provides an insulating effect that is high-strength and provides an in-cavity thermal break, severing the thermal threads created from the interlocking anchoring system components. The single construct veneer tie serves as a high-strength interconnecting component and includes a seismic interconnection.

In the above description of the anchoring systems of this invention various configurations are described and applications thereof in corresponding anchoring systems are provided. Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense. Thus minor changes may be made without departing from the spirit of the invention.

What is claimed is:

1. A dovetail anchoring system for the interconnection of a masonry inner wythe and an outer wythe formed from a plurality of successive courses of masonry block with a bed joint, having a predetermined height, between each two adjacent courses, the inner wythe and the outer wythe in a spaced apart relationship the one with the other forming a cavity therebetween, the anchoring system comprising:

a dovetail wall anchor configured to be secured within the inner wythe and constructed from a sheetmetal body having two major faces being the mounting surface and the outer surface, the wall anchor, in turn, comprising:

a dovetail slot formed from the outer surface and extending the length of the outer surface; and, a sheetmetal veneer tie comprising:

an insertion portion having a first end configured for securement within the outer wythe bed joint and a second end contiguous with the first end; and, an interconnecting portion contiguous with the second end and opposite the first end, the interconnecting portion configured to be adjustably mounted within the dovetail slot; and, a thermally-isolating coating disposed only on the insertion portion, the coating having low thermal conductivity and transmissivity, the coating forming a thermal break in the cavity;

wherein upon installation within the anchoring system in the cavity wall, the veneer tie restricts thermal transfer between the veneer tie and the wall anchor and between the wall anchor and the veneer tie.

2. The anchoring system according to claim 1, wherein the thermally-isolating coating is one or more layers of a compound selected from the group consisting of thermoplastics, thermosets, natural fibers, rubbers, resins, asphalts, ethylene propylene diene monomers, and admixtures thereof.

3. The anchoring system according to claim 2, wherein the selected compound is an isotropic polymer selected from the group consisting of acrylics, nylons, epoxies, silicones, polyesters, polyvinyl chlorides, and chlorosulfonated polyethelenes.

4. The anchoring system according to claim 3, wherein the thermally-isolating coating is applied in layers including a prime coat; and wherein, upon curing, the outer layers of the thermally-isolating coating are cross-linked to the prime coat to provide high-strength adhesion to the veneer tie insertion portion first end.

5. The anchoring system according to claim 4, wherein the thermally-isolating coating reduces the K-value of the veneer tie to a level not to exceed 1.0 W/m K.

6. The anchoring system according to claim 4, wherein the thermally-isolating coating reduces the U-value of the veneer tie to a level not to exceed 0.35 $W/m^2K$.

7. The anchoring system according to claim 4, wherein the thermally-isolating coating comprises a matte finish to securely hold to the bed joint and increase the strength and pullout resistance thereof.

8. The anchoring system according to claim 4, wherein the thermally-isolating coating is further applied to the insertion portion second end and the interconnecting portion.

9. The anchoring system of claim 4 wherein the veneer tie is a single construct.

10. The anchoring system of claim 9 wherein the veneer tie further comprises:

a seismic notch formed from the insertion portion first end, the seismic notch dimensioned for a snap-fit relationship with a reinforcement wire; and a reinforcement wire disposed in the seismic notch;

whereby upon insertion of the reinforcement wire in the seismic notch a seismic construct is formed.

11. The anchoring system of claim 10 wherein the seismic notch further comprises:

two securement tabs set opposite each other; and, a securement depression, the securement depression contiguous with each of the two securement tabs forming a seat to accommodate the continuous wire.

12. The anchoring system of claim 11 wherein the dovetail anchor is a metal alloy constructed of material selected from a group consisting of mill galvanized steel, hot-dip galvanized steel, stainless steel, and bright basic steel.

13. The anchoring system of claim 12 wherein the veneer tie is a metal alloy constructed of material selected from a group consisting of mill galvanized steel, hot-dip galvanized steel, stainless steel, and bright basic steel.

14. The anchoring system of claim 13 wherein the inner wythe further comprises a layer of insulation selected from a group consisting of rigid insulation, board insulation, and spray-on insulation.

15. A veneer tie for use in a cavity wall to connect to a wall anchor to join an inner wythe and an outer wythe of the cavity wall, the veneer tie comprising:

an insertion portion configured for securement within a bed joint of the outer wythe of the cavity wall;

an interconnecting portion contiguous with the insertion portion, the interconnecting portion having a dovetail shape and being configured for mounting within a slot of the wall anchor; and a thermally-isolating coating disposed only on the insertion portion, the coating having low thermal conductivity and transmissivity, the coating being configured to reduce thermal transfer in the cavity wall between the veneer tie and the wall anchor when the veneer tie is attached to the wall anchor.

16. A unitary sheet metal veneer tie for use in a cavity wall to connect to a wall anchor to join an inner wythe and an outer wythe of the cavity wall, the veneer tie comprising:

an insertion portion having a first end configured for securement within a bed joint of the outer wythe of the cavity wall and a second end contiguous with the first end, the first end of the insertion portion forming a notch configured to receive a reinforcement wire, the notch comprising a seat formed by bending a portion of the insertion portion out of plane, the seat having a first portion bent downward out of plane from the first end of the insertion portion and a second portion bent upward from the first portion, the seat being configured to receive the reinforcement wire the notch further comprising a first securement tab struck from the insertion portion, the first securement tab being positioned adjacent the seat and configured to retain the reinforcement wire in the seat and a second securement tab struck from the insertion portion, the second securement tab being positioned adjacent the seat opposite the first securement tab, such that the seat is positioned between the first and second securement tabs, the first and second securement tabs being configured to receive and retain the reinforcement wire, the first and second securement tabs being configured to be positioned on opposite sides of a longitudinal axis of the reinforcement wire; and an interconnecting portion contiguous with the second end of the insertion portion, the interconnecting portion having a dovetail shape and being configured for mounting within a slot of the wall anchor.

17. A veneer tie according to claim 16, further comprising a thermally-isolating coating disposed on the insertion portion, the coating having low thermal conductivity and transmissivity, the coating being configured to reduce thermal transfer in the cavity wall between the veneer tie and the wall anchor when the veneer tie is attached to the wall anchor.

18. A veneer tie according to claim 17, in combination with a dovetail wall anchor configured for securement within the inner wythe and having a dovetail slot configured to receive the interconnecting portion of the veneer tie.

* * * * *